US010927324B1

(12) United States Patent
Sun et al.

(10) Patent No.: US 10,927,324 B1
(45) Date of Patent: Feb. 23, 2021

(54) UNIT-DOSE DETERGENT COMPOSITIONS CONTAINING POLYETHYLENE GLYCOL AND AN ORGANIC ACID

(71) Applicant: Henkel IP & Holding GmbH, Duesseldorf (DE)

(72) Inventors: Wei Sun, Trumbull, CT (US); Narcisse N. Toussa, Seymour, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 0 days.

(21) Appl. No.: 16/554,119

(22) Filed: Aug. 28, 2019

(51) Int. Cl.

| | |
|---|---|
| ***C11D 1/37*** | (2006.01) |
| ***C11D 1/04*** | (2006.01) |
| ***C11D 1/29*** | (2006.01) |
| ***C11D 1/722*** | (2006.01) |
| ***C11D 11/00*** | (2006.01) |
| ***C11D 17/04*** | (2006.01) |
| ***C11D 3/43*** | (2006.01) |
| ***C11D 3/20*** | (2006.01) |

(52) U.S. Cl.
CPC ..... *C11D 1/04* (2013.01); *C11D 1/29* (2013.01); *C11D 1/722* (2013.01); *C11D 3/2086* (2013.01); *C11D 3/43* (2013.01); *C11D 11/0017* (2013.01); *C11D 17/042* (2013.01)

(58) Field of Classification Search
CPC .... C11D 1/22; C11D 1/29; C11D 1/37; C11D 1/722; C11D 3/2044; C11D 17/042
See application file for complete search history.

(56) References Cited

U.S. PATENT DOCUMENTS

| | | | | |
|---|---|---|---|---|
| 10,066,195 | B2 | 9/2018 | Keuleers et al. | |
| 10,093,889 | B2 * | 10/2018 | Fang | C11D 1/66 |
| 2002/0198130 | A1 | 12/2002 | Arvanitidou et al. | |
| 2003/0119696 | A1 * | 6/2003 | Ingram | C11D 17/042 510/296 |
| 2009/0320212 | A1 * | 12/2009 | Brown | C11D 17/043 8/137 |
| 2010/0056419 | A1 * | 3/2010 | Corona, III | C11D 11/007 510/338 |
| 2010/0056421 | A1 * | 3/2010 | Corona, III | C11D 3/0021 510/360 |
| 2010/0155659 | A1 | 6/2010 | Yang et al. | |
| 2012/0175797 | A1 * | 7/2012 | Labeque | C11D 3/2068 264/4 |
| 2016/0040105 | A1 * | 2/2016 | Depoot | C11D 1/83 510/296 |
| 2017/0226449 | A1 | 8/2017 | Keuleers et al. | |
| 2017/0292097 | A1 | 10/2017 | Fang et al. | |
| 2018/0094220 | A1 | 4/2018 | Chieffi et al. | |
| 2018/0179477 | A1 | 6/2018 | Ure et al. | |
| 2018/0334641 | A1 | 11/2018 | Piorkowski | |
| 2018/0362904 | A1 | 12/2018 | Somerville Roberts et al. | |

OTHER PUBLICATIONS

International Searching Authority, PCT International Search Report, PCT/US2020/048212, dated Dec. 9, 2020, pp. 4-5 (of 11), Korean Intellectual Property Office, Daejeon, South Korea.

* cited by examiner

*Primary Examiner* — Charles I Boyer
(74) *Attorney, Agent, or Firm* — Bojuan Deng

(57) ABSTRACT

A detergent composition includes at least one sulfur-containing ionic surfactant, at least one non-aqueous solvent including a polyethylene glycol having a molecular weight of from about 200 to about 3000, and an organic acid. The detergent composition may be contained within the water-soluble film of a unit dose pack.

13 Claims, 1 Drawing Sheet

| Age Condition | Unit Dose product appearance comparing **reference (left)** and **inventive (right)** examples | |
|---|---|---|
| | Up | Bottom |
| 24C 4 weeks | 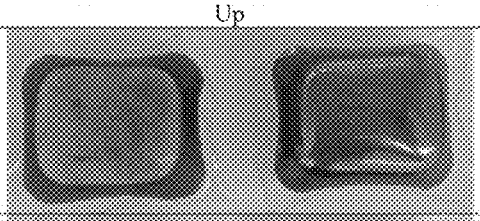 | 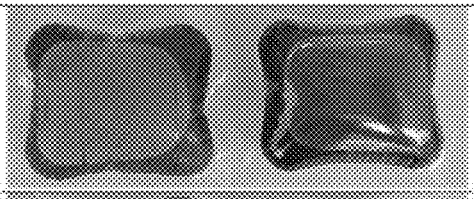 |
| 40C 4 weeks | 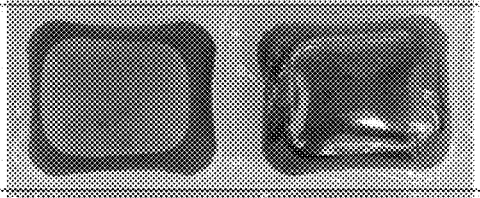 | 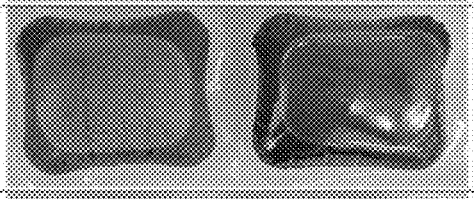 |
| 45C 4 weeks | 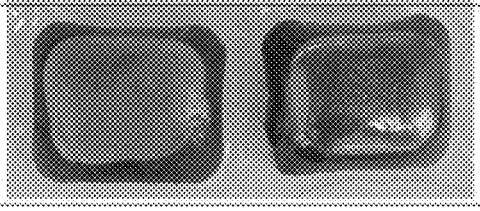 | 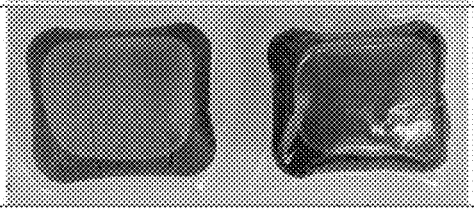 |

UNIT-DOSE DETERGENT COMPOSITIONS CONTAINING POLYETHYLENE GLYCOL AND AN ORGANIC ACID

FIELD OF THE INVENTION

The present disclosure relates to detergent compositions contained in a unit dose pack. More particularly, the present disclosure provides unit dose pack detergent compositions containing polyethylene glycol and an organic acid for improved pack aesthetics under storage conditions.

BACKGROUND OF THE INVENTION

Detergent formulators are faced with the task of devising products to remove a broad spectrum of soils and stains from fabrics. Chemically and physio-chemically, the varieties of soils and stains range the spectrum from polar soils and inorganic soils, to non-polar soils, to organic soils. Detergent compositions have become more complex as formulators attempt to provide products that handle all types concurrently.

Water-soluble unit dose articles (packs) are preferred by some consumers due to their convenience and ease of use during laundry operation. Such water-soluble unit dose packs include a water-soluble film, for example a polyvinyl alcohol-containing film. The liquid laundry detergent composition is packaged in a cavity that is surrounded by the film. Such liquid laundry detergent compositions include one or more non-soap surfactants to provide cleaning benefits.

Of the various non-soap surfactants suitable for use in the detergent compositions, anionic surfactants, in addition to their soil removal benefit, are known as useful additives in laundry detergent compositions for the purpose of providing the laundered fabrics with a whiteness maintenance, a desired foaming, and a sanitization benefit. One type of anionic surfactant is alkyl ether sulfates (AES). AES foams easily in water, and is able to remove a wide variety of soils. Another type of anionic surfactant is linear alkylbenzene sulfonates (LAS), which is a water-soluble salt of a linear alkyl benzene sulfonic acid having between 8 and 22 carbon atoms of the linear alkyl group. LAS is beneficial for removing oily and fatty soils, and it is widely used in a variety of cleaning compositions.

The commercially available alkyl ether sulfate, however, usually contains sodium sulfate, which is a by-product produced during the sulfation process. During storage of the unit dose packs, the amount of sodium sulfate brought by alkyl ether sulfate in the liquid laundry composition can migrate from the liquid phase to the surrounding film, and consequently result in crystalline deposits of sodium sulfate onto the film, which is referred to as efflorescence. Furthermore, the linear alkylbenzene sulfonate provides an amount of sulfate anions into liquid detergent, coming from the neutralization of excess sulfuric acid in the composition of commercially available alkyl sulfonic acid, which reduces the solubility of sodium sulfate and therefore promotes the growth of efflorescence on the film. Still further, sodium sulfite or bisulfate, which in some detergent formulations is used to prevent discoloration, as well as any other ingredients that provide a sodium salt, such as sodium polyacrylate and optical brighteners, may also promote the growth of efflorescence on the film.

It has been observed that the aforementioned efflorescence causes an undesired product aesthetic, which may negatively impact consumer perception of the unit dose pack. Accordingly, it would be desirable to provide detergent formulations for unit dose packs that reduce or slow down the formation efflorescence on the film to improve product aesthetics during storage without limiting the use of commercially available anionic surfactants such as alkyl ether sulfate and linear alkyl sulfonate, as well as any sodium salts. Furthermore, other desirable features and characteristics will become apparent from the subsequent detailed description and the appended claims, taken in conjunction with the accompanying drawings and the foregoing technical field and background.

BRIEF SUMMARY OF THE INVENTION

It has been surprisingly discovered by the inventors herein that the use of an organic acid in combination with particular molecular weight polyethylene glycol (PEG) solvents in a detergent composition for a water-soluble unit does pack significantly reduces and/or slows down the formation efflorescence on the pack film under storage conditions. In particular, it has been shown that unit does packs stored for up to four weeks exhibit significantly less efflorescence when an organic acid, such as citric acid, in combination with a PEG having a molecular weight of from about 200 to about 3000 are provided as components of the detergent composition contained within the unit dose packs.

Accordingly, in one exemplary embodiment of the present disclosure, provided is a detergent composition that includes at least one sulfur-containing ionic surfactant, at least one non-aqueous solvent including a polyethylene glycol having a molecular weight of from about 200 to about 3000, and an organic acid.

In another exemplary embodiment, provided is a unit dose pack that includes a water-soluble film container and a detergent composition contained within the water-soluble film container. The detergent composition includes at least one sulfur-containing ionic surfactant, at least one non-aqueous solvent including a polyethylene glycol having a molecular weight of from about 200 to about 3000, and an organic acid.

In further aspects of the present disclosure, provided is a detergent composition for use in a unit dose pack that includes at least one sulfur-containing ionic surfactant selected from the group of: an alkyl ether sulfate that is present in an amount of from about 0% to about 35%, based on total weight of the detergent composition, a linear alkylbenzene sulfonate that is present in an amount of about 1% to about 30%, based on total weight of the detergent composition, and mixtures thereof; at least one non-aqueous solvent including a polyethylene glycol having a molecular weight of from about 200 to about 3000 that is present in an amount of about 1% to about 40%, based on total weight of the detergent composition; water in an amount of about 5% to about 35%, based on total weight of the detergent composition; an organic acid selected from the group of: citric acid, maleic acid, lactic acid, propionic acid, valeric acid, caproic acid, carbonic acid, adipic acid, gluconic acid, methylglycinediacetic acid, and a mixture thereof that is present in an amount of about 0.1% to about 5%, based on total weight of the detergent composition; and at least one beneficial composition selected from the group of: enzymes, peroxy compounds, bleach activators, anti-redeposition agents, neutralizers, optical brighteners, foam inhibitors, chelators, buttering agents, dye transfer inhibitors, soil release agents, water softeners, and mixtures thereof This brief summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWING

Illustrated in FIG. 1 is an image that shows the efflorescence formed on various comparative and inventive unit dose packs under various storage condition temperatures.

DETAILED DESCRIPTION OF THE INVENTION

The following detailed description is merely exemplary in nature and is not intended to limit the single dose pack, or the method for producing or using the same. Furthermore, there is no intention to be bound by any theory presented in the preceding background or the following detailed description.

The following description provides specific details, such as materials and dimensions, to provide a thorough understanding of the present disclosure. The skilled artisan, however, will appreciate that the present disclosure can be practiced without employing these specific details. Indeed, the present disclosure can be practiced in conjunction with processing, manufacturing, or fabricating techniques conventionally used in the detergent industry. Moreover, the processes below describe only steps, rather than a complete process flow, for manufacturing the detergent compositions containing the inventive surfactant system according to the present disclosure.

As used herein, "a," "an," or "the" means one or more unless otherwise specified. The term "or" can be conjunctive or disjunctive. Open terms such as "include," "including," "contain," "containing" and the like mean "comprising." The term "about" as used in connection with a numerical value throughout the specification and the claims denotes an interval of accuracy, familiar and acceptable to a person skilled in the art. In general, such interval of accuracy is ±10%. Thus, "about ten" means 9 to 11. All numbers in this description indicating amounts, ratios of materials, physical properties of materials, and/or use are to be understood as modified by the word "about," except as otherwise explicitly indicated. As used herein, the "%" described in the present disclosure refers to the weight percentage unless otherwise indicated. As used herein, the phrase "substantially free of" means that a composition contains little no specified ingredient/component, such as less than about 1 wt %, 0.5 wt %, or 0.1 wt %, or below the detectable level of the specified ingredient. Unless stated otherwise, molecular weight of a polymer, such as polyethylene glycol, refers to weight average molecular weight.

In one aspect, the present disclosure provides a detergent composition for use in a single dose pack that includes anionic, sulfur-containing surfactants such as alkyl ether sulfates and/or linear alkylbenzene sulfonates, as well as possibly sodium salt-containing compounds, in combination with an organic acid and particular molecular weight polyethylene glycol solvent(s). The detergent composition of the present disclosure may be formulated into a single (unit) dose pack. A unit dose pack is formed by encapsulating a detergent composition within a container, where the container is composed of a film, such as a polyvinyl alcohol-containing film. In some embodiments, the film forms one half or more of the container, where the container may also include dyes, print, or other components in some embodiments. The film is water soluble such that the film will completely dissolve when an exterior of the film is exposed to water, such as in a washing machine typically used for laundry. When the film dissolves, the container is ruptured and the contents are released. In some embodiments, the detergent composition of the present disclosure further includes one or more beneficial compositions that may include, for example, a fragrance composition, a color care agent, an anti-redeposition agent, or a softening agent, among others as will be discussed in greater detail below.

As mentioned above, the detergent composition may include one or more sulfur-containing surfactants. One such surfactant is a polyethoxylated alcohol sulfate, such as those sold under the trade name CALFOAM® 303 (Pilot Chemical Company, California). Such materials, also known as alkyl ether sulfates (AES) or alkyl polyethoxylate sulfates, are those which correspond to the following formula (A):

$$R'—O—(C2H4O)n\text{-}SO3M' \quad (A)$$

wherein R' is a C8-C20 alkyl group, n is from 1 to 20, and M' is a salt-forming cation, preferably, R' is C10-C18 alkyl, n is from 1 to 15, and M' is sodium, potassium, ammonium, alkylammonium, or alkanolammonium. In another embodiment, R' is a C12-C16 alkyl, n is from 1 to 6 and M' is sodium. In another embodiment, the alkyl ether sulfate is sodium lauryl ether sulfate (SLES).

The AES may be present in the detergent composition in an amount ranging from about 0% to about 30%, or about 5% to about 30%, or about 10% to about 25%, or about 10% to about 30%, or about 0% to about 20%, or about 20% to about 30%, based on the total weight of the detergent composition. In other embodiments, the AES may be present in the detergent composition in an amount ranging from about 0% to about 10%, or about 10% to about 15%, or about 15% to about 20%, or about 20% to about 25%, or about 25% to about 30, based on the total weight of the detergent composition.

In accordance with the present disclosure, another possible sulfur-containing surfactant is a linear alkylbenzene sulfonic acid or a salt thereof. Linear alkylbenzene sulfonate (LAS) is a water soluble salt of a linear alkyl benzene sulfonate having between 8 and 22 carbon atoms of the linear alkyl group. The salt can be an alkali metal salt, or an ammonium, alkylammonium, or alkanolammonium salt. In one embodiment, the LAS includes an alkali metal salt of $C_{10}$-$C_{16}$ alkyl benzene sulfonic acids, such as $C_{11}$-$C_{14}$ alkyl benzene sulfonic acids.

The LAS may be present in the detergent composition in an amount ranging from about 1% to about 30%, or about 3% to about 30%, or about 1% to about 25%, or about 5% to about 20%, or about 1% to about 10%, based on the total weight of the detergent composition. In other embodiments, the LAS may be present in the detergent composition in an amount ranging from about 1% to about 5%, or about 5% to about 10%, or about 10% to about 20%, or about 20% to about 30%, based on the total weight of the detergent composition.

Of course, the detergent composition may include other surfactants beyond anionic, sulfur-containing surfactants such as those previously described. For example, in accordance with the present disclosure, another possible surfactant that may be included in the detergent composition is a nonionic alcohol ethoxylate (AE). The AE may be primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles, or from 3 to 8 moles of ethylene oxide per mole of alcohol. Exemplary AEs are the condensation products of aliphatic $C_8$-$C_{20}$, preferably $C_8$-$C_{16}$, primary or secondary, linear or branched chain alcohols with ethylene oxide. In some embodiments, the alcohol ethoxylates contain 1 to 20, or 3 to 8 ethylene oxide groups, and may optionally be end-capped by a hydroxylated alkyl group.

In one embodiment, the AE has Formula (B):

$$R_2—(—O—C_2H_4—)_m—OH \quad (B)$$

wherein $R_2$ is a hydrocarbyl group having 8 to 16 carbon atoms, 8 to 14 carbon atoms, 8 to 12 carbon atoms, or 8 to 10 carbon atoms; and m is from 1 to 20, or 3 to 8. The hydrocarbyl group may be linear or branched, and saturated or unsaturated. In some embodiments, $R_2$ is a linear or branched $C_8$-$C_{16}$ alkyl or a linear group or branched $C_8$-$C_{16}$ alkenyl group. Preferably, $R_2$ is a linear or branched $C_8$-$C_{16}$ alkyl, $C_8$-$C_{14}$ alkyl, or $C_8$-$C_{10}$ alkyl group. In case (e.g., commercially available materials) where materials contain a range of carbon chain lengths, these carbon numbers represent an average. The alcohol may be derived from natural or synthetic feedstock. In one embodiment, the alcohol feedstock is coconut, containing predominantly $C_{12}$-$C_{14}$ alcohol, and oxo $C_{12}$-$C_{15}$ alcohols. One suitable AE is Tomadol® 25-7 (available from Air Product). Other suitable AEs include Genapol® C200 (available from Clamant), which is a coco alcohol having an average degree of ethoxylation of 20.

The AE may be present in the detergent composition in an amount ranging from about 3% to about 35%, or about 5% to about 35%, or about 8% to about 30%, or about 15% to about 35%, or about 3% to about 25%, or about 8% to about 30%, based on the total weight of the detergent composition. In other embodiments, the AE may be present in the detergent composition in an amount ranging from about 3% to about 10%, or about 10% to about 15%, or about 15% to about 20%, or about 20% to about 25%, or about 25% to about 30%, or about 30% to about 35%, based on the total weight of the detergent composition.

As a further example of a surfactant, optionally, the detergent composition of the present disclosure may additionally include a fatty acid. Suitable fatty acid may be any fatty acid having formula: R3-C(O)OH, wherein R3 is a C5-C21 linear or branched aliphatic group. Preferably, the R3 is a C13-C21 linear or branched aliphatic group. In some embodiments, the fatty acid is hexanoic acid, heptanoic acid, octanoic acid, nonanoic acid, capric acid, undecanoic acid, dodecanoic acid (lauric acid), tridecanoic acid, myristic acid, pentadecanoic acid, palmitic acid, heptadecanoic acid, stearic acid, nonadecanoic acid, eicosanoic acid, heneicosanoic acid, docosanoic acid, myristoleic acid, palmitoleic acid, sapienic acid, oleic acid, elaidic acid, vaccenic acid, linoleic acid, linoelaidic acid, arachidonic acid, eicosapentaenoic acid, erucic acid, docosahexaenoic acid, or a mixture thereof. In some embodiments, the fatty acid is dodecanoic acid (also known as coconut fatty acid).

In some embodiments, the surfactant system of the present disclosure contains from about 1% to about 20%, from about 1% to about 15%, from about 1% to about 10%, from about 1% to about 6%, or from about 1% to 4% fatty acid, based on the total weight the detergent composition. In some embodiments, the surfactant system of the present disclosure contains from about 3% to about 10% of fatty acid based on the total weight the detergent composition.

In its entirety, the various surfactants as described above may compose about 25% to about 75%, or about 35% to about 75%, or about 25% to about 65%, or about 45% to about 75%, or about 25% to about 55% of the total weight of the detergent composition. In other embodiment, the surfactants may compose about 25% to about 35%, or about 35% to about 45%, or about 45% to about 55%, or about 55% to about 65%, or about 65% to about 75% of the total weight of the detergent composition.

As initially noted above, the detergent composition also includes a solvent system. The solvents in the solvent system include water and at least one non-aqueous solvent including at least polyethylene glycol. The detergent composition may include from about 15% to about 75%, preferably from about 25% to about 70%, and more preferably from about 30% to about 65% of all of the solvents in a solvent system, based on the total weight of the detergent composition. In some embodiments, the detergent composition includes from about 15% to about 20%, from about 20% to about 25%, from about 25% to about 30%, from about 30% to about 35%, from about 35% to about 40%, from about 40% to about 45%, from about 45% to about 50%, from about 50% to about 55%, from about 55% to about 60%, from about 60% to about 65%, from about 65% to about 70%, and from about 70% to about 75% all of the solvents, based on the total weight of the detergent composition. Besides the PEG, suitable non-aqueous solvents for the solvent system may include other polyols, ionic liquids, glycol ethers, EO/PO block copolymers, alcohols such as ethanol, and mixtures thereof. The non-aqueous solvents should be miscible with water, in particularly in the presence of surfactants. Such non-aqueous solvents often, if not all, have a hydroxyl functional group.

In the disclosed embodiments, the solvent system includes polyethylene glycol. As conventionally used in the art, the use of polyethylene glycol (PEG) alone, not followed by a number, refers to PEG with all possible Mw. The use of PEG with a specific number, for example, "PEG 400", indicates that that PEG having a weight average molecular weight of about 400. PEGs suitable for the present disclosure can have a weight average molecular weight ranging, for example, from about 200 to about 3000, about 200 to about 2000, or about 400 to about 1000. For example, PEGs suitable for use can have a weight average molecular weight of from about 200 to about 800, from about 800 to about 1200, from about 1200 to about 1600, from about 1600 to about 2000, from about 2000 to about 2500, or from about 2500 to about 3000. Suitable PEGs can have a weight average molecular weight of, for example, about 200, about 400, about 500, about 600, about 700, about 800, about 900, about 1000, about 1100, about 1200, about 1300, about 1400, about 1500, about 1600, about 1700, about 1800, about 1900, about 2000, about 2100, about 2200, about 2300, about 2400, about 2500, or about 2600, about 2700, about 2800, about 2900, or about 3000. In some embodiments, the PEGs are selected from a group of PEG 200, PEG 400, PEG 1000, PEG 1500, PEG 2000, PEG 2500, PEG 3000, and a mixture thereof. In some embodiments, the detergent compositions of the present disclosure may contain 1% to about 40% of one or more PEGs, preferably from about 2% to about 30%, more preferably from about 5% to about 25%, and most preferably from about 8% to about 20%, by weight of the entire formulation.

Further, in some embodiments, the solvent system includes glycerin as a non-aqueous solvent. Glycerin is preferably provided in an amount of from about 5% to about 30%, more preferably from about 8% to about 20%, by weight of the entire detergent composition. In some embodiments, the solvent system includes less propylene glycol than glycerin by weight. In some embodiments, the solvent system includes more propylene glycol than glycerin by weight.

Total water content in the detergent composition is the sum of added water (i.e., 100% or substantially 100% water) and water contained in other ingredients of the detergent composition. In some embodiments, the detergent composition includes from about 5% to about 35%, preferably from about 7.5% to about 30%, more preferably from about 10% to about 25%, and even more preferably from about 10% to about 20% of total water, based on the total weight of the detergent composition. In some embodiments, there is less water than non-aqueous solvents by weight.

The detergent compositions of the present disclosure as include an organic acid. As used herein, the term "organic acid" refers to organic compounds that have a carboxylic acid functionality (R—COOH, wherein R is a carbon-containing group). Suitable examples of organic acids include citric acid, maleic acid, lactic acid, propionic acid, valeric acid, caproic acid, carbonic acid, adipic acid, gluconic acid, methylglycinediacetic acid or a mixture thereof. In an exemplary embodiment, the organic acid is citric acid. The organic acid may be included in the detergent composition in an amount of about 0.1% to about 5%, such as about 0.2% to about 4%, or about 0.5% to about 2%, by weight of the overall detergent composition. For example, the organic acid may be included in an amount of about 0.1% to about 0.5%, about 0.5% to about 1.5%, about 1.5% to about 2.5%, or about 2.5% to about 5%.

As noted above, in some embodiments, one or more beneficial compositions may optionally be added to and included in the detergent composition, including but not limited to enzymes, peroxy compounds, bleach activators, anti-redeposition agents, neutralizers, optical brighteners, foam inhibitors, chelators, buttering agents, dye transfer inhibitors, soil release agents, water softeners, and other components. In further embodiments, additional beneficial compositions include electrolytes, pH regulators, graying inhibitors, anti-crease components, bleach agents, colorants, scents, processing aids, antimicrobial agents, and preservatives. Combinations of any of the foregoing may be used in a detergent composition.

Possible enzymes that may be in the detergent composition contemplated herein include one or more of a protease, lipase, cutinase, amylase, carbohydrase, cellulase, pectinase, mannanase, arabinase, galactanase, xylanase, oxidase, (e.g., a laccase), and/or peroxidase, but others are also possible. In general, the properties of the selected enzyme(s) should be compatible with the selected detergent composition, (i.e., pH-optimum, compatibility with other enzymatic and non-enzymatic ingredients, etc.). The detergent enzyme(s) may be included in the detergent composition by adding separate additives containing one or more enzymes, or by adding a combined additive including all the enzymes that are added to the detergent composition. The enzyme(s) should be present in the detergent composition in effective amounts, such as from about 0 weight percent to about 5 weight percent of enzyme, or from about 0.001 to about 1 weight percent, or from about 0.2 to about 2 weight percent, or from about 0.5 to about 1 weight percent, based on the total weight of the detergent composition, in various embodiments.

As alluded to above, a peroxy compound may optionally be present in the detergent composition. Exemplary peroxy compounds include organic peracids or peracidic salts of organic acids, such as phthalimidopercaproic acid, perbenzoic acid or salts of diperdodecanedioic acid, hydrogen peroxide and inorganic salts that release hydrogen peroxide under the washing conditions, such as perborate, percarbonate and/or persilicate. Hydrogen peroxide may also be produced with the assistance of an enzymatic system, i.e. an oxidase and its substrate. Other possible peroxy compounds include alkali metal percarbonates, alkali metal perborate monohydrates, alkali metal perborate tetrahydrates or hydrogen peroxide. Peroxy compounds may be present in the detergent composition at an amount of from about 0 to about 50 weight percent, or an amount of from about 3 to about 30 weight percent, or an amount of from about 3 to about 10 weight percent, based on the total weight of the detergent composition, in various embodiments.

Bleach activators may optionally be added and included in the detergent composition. Conventional bleach activators that form peroxycarboxylic acid or peroxyimidic acids under perhydrolysis conditions and/or conventional bleach-activating transition metal complexes may be used. The bleach activator optionally present may include, but is not limited to, one or more of: N- or O-acyl compounds, for example polyacylated alkylenediamines, such as tetraacetylethylenediamine; acylated glycolurils, such as tetraacetylglycoluril; N-acylated hydantoins; hydrazides; triazoles; urazoles; diketopiperazines; sulfurylamides and cyanurates; carboxylic anhydrides, such as phthalic anhydride; carboxylic acid esters, such as sodium isononanoylphenolsulfonate; acylated sugar derivatives, such as pentaacetyl glucose; and cationic nitrile derivatives such as trimethylammonium acetonitrile salts.

To avoid interaction with peroxy compounds during storage, the bleach activators may be coated with shell substances or granulated prior to addition to the detergent composition, in a known manner. As such, the bleach activator and/or other components may be present in a liquid detergent composition as a free or floating particulate. Exemplary embodiments of the coating or shell substance include tetraacetylethylenediamine granulated with the assistance of carboxymethylcellulose and having an average grain size of 0.01 mm to 0.8 mm, granulated 1,5-diacetyl-2,4-dioxohexahydro-1,3,5-triazine, and/or trialkylammonium acetonitrile formulated in particulate form. In alternative embodiments, the bleach activators may be enclosed in a compartment, separate from the compartment that contains peroxy compounds and/or other compounds of the detergent composition. In various embodiments, the bleach activators may be present in the detergent composition in quantities of from about 0 to about 8 weight percent, or from about 0 to about 6 weight percent, or from about 0 to about 4 weight percent, in each case relative to the total weight of the detergent composition.

One or more anti-redeposition agents may also be optionally included in the detergent composition. Anti-redeposition agents include polymers with a soil detachment capacity, which are also known as "soil repellents" due to their ability to provide a soil-repelling finish on the treated surface, such as a fiber. Anti-redeposition agents include polymers with a soil detachment capacity. One example in regard to polyesters includes copolyesters prepared from dicarboxylic acids, such as adipic acid, phthalic acid or terephthalic acid. In an exemplary embodiment, an anti-redeposition agents includes polyesters with a soil detachment capacity that include those compounds which, in formal terms, are obtainable by esterifying two monomer moieties, the first monomer being a dicarboxylic acid HOOC-Ph-COOH and the second monomer a diol HO—($CHR^{11}$-)aOH, which may also be present as a polymeric diol H—(O—($CHR^{11}$—)$_a$)$_b$OH. Ph here means an ortho-, meta- or para-phenylene residue that may bear 1 to 4 substituents selected from alkyl residues with 1 to 22 C atoms, sulfonic acid groups, carboxyl groups and mixtures thereof. $R^{11}$ means hydrogen or an alkyl residue with 1 to 22 C atoms and mixtures thereof "a" means a number from 2 to 6 and "b" means a number from 1 to 300. The polyesters obtainable therefrom may contain not only monomer diol units —O—(CHR$^{11}$—)$_a$O— but also polymer diol units —(O—(CHR$^{11}$—)$_a$)$_b$O—. The molar ratio of monomer diol units to polymer diol units may amount to from about 100:1 to about 1:100, or from about 10:1 to about 1:10 in another embodiment. In the polymer diol units, the degree of polymerization "b" may be in the range of from about 4 to about 200, or from about 12 to about 140 in an alternate embodiment. The average molecular weight of the polyesters with a soil detachment capacity may be in the range of from about 250 to about 100,000, or from about 500 to about 50,000 in an alternate embodiment. The acid on which the residue Ph is based may be selected from terephthalic acid, isophthalic acid, phthalic acid, trimellitic acid, mellitic acid, the isomers of sulfophthalic acid, sulfoisophthalic acid and sulfoterephthalic acid and mixtures thereof. Where the acid groups thereof are not part of the ester bond in the polymer, they may be present in salt form, such as an alkali metal or ammonium salt. Exemplary embodiments include sodium and potassium salts.

If desired, instead of the monomer HOOC-Ph-COOH, the polyester with a soil detachment capacity (the anti-redeposition agent) may include small proportions, such as no more than about 10 mole percent relative to the proportion of Ph with the above-stated meaning, of other acids that include at least two carboxyl groups. These include, for example, alkylene and alkenylene dicarboxylic acids such as malonic acid, succinic acid, fumaric acid, maleic acid, glutaric acid, adipic acid, pimelic acid, suberic acid, azelaic acid and sebacic acid. Exemplary diols HO—(CHR$^{11}$—)$_a$OH include those in which $R^{11}$ is hydrogen and "a" is a number of from about 2 to about 6, and in another embodiment includes those in which "a" has the value of 2 and $R^{11}$ is selected from hydrogen and alkyl residues with 1 to 10 C atoms, or where $R^{11}$ is selected from hydrogen and alkyl residues with 1 to 3 C atoms in another embodiment. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol and neopentyl glycol. The polymeric diols include polyethylene glycol with an average molar mass in the range from about 1000 to about 6000. If desired, these polyesters may also be end group-terminated, with end groups that may be alkyl groups with 1 to 22 C atoms or esters of monocarboxylic acids. The end groups attached via ester bonds may be based on alkyl, alkenyl and aryl monocarboxylic acids with 5 to 32 C atoms, or with 5 to 18 C atoms in another embodiment. These include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselinic acid, petroselaidic acid, oleic acid, linoleic acid, linolaidic acid, linolenic acid, eleostearic acid, arachidic acid, gadoleic acid, arachidonic acid, behenic acid, erucic acid, brassidic acid, clupanodonic acid, lignoceric acid, cerotic acid, melissic acid, benzoic acid, which may bear 1 to 5 substituents having a total of up to 25 C atoms, or 1 to 12 C atoms in another embodiment, for example tert-butylbenzoic acid. The end groups may also be based on hydroxymonocarboxylic acids with 5 to 22 C atoms, which for example include hydroxyvaleric acid, hydroxycaproic acid, ricinoleic acid, the hydrogenation product thereof, hydroxystearic acid, and ortho-, meta- and para-hydroxybenzoic acid. The hydroxymonocarboxylic acids may in turn be joined to one another via their hydroxyl group and their carboxyl group and thus be repeatedly present in an end group. The number of hydroxymonocarboxylic acid units per end group, i.e. their degree of oligomerization, may be in the range of from 1 to 50, or in the range of from 1 to 10 in another embodiment. In an exemplary embodiment, polymers of ethylene terephthalate and polyethylene oxide terephthalate, in which the polyethylene glycol units have molar weights of from about 750 to about 5000 and the molar ratio of ethylene terephthalate to polyethylene oxide terephthalate of from about 50:50 to about 90:10, are used alone or in combination with cellulose derivatives. The anti-redeposition agent is present in the detergent composition at an amount of from about 0 to about 3 weight percent, or an amount of from about 0 to about 2 weight percent, or an amount of from about 0 to about 1 weight percent, based on the total weight of the detergent composition, in various embodiments.

Neutralizers are optionally added to and included in the detergent composition. Exemplary neutralizers include, but are not limited to, sodium hydroxide, triethanol amine, monoethanol amine, buffers, or other compounds that adjusts the pH of the detergent composition. Neutralizers may be present in the detergent composition at an amount of from about 0 to about 10 weight percent in some embodiments, based on the total weight of the detergent composition, but in other embodiments the neutralizer may be present in the detergent composition at an amount of from about 0 to about 8 weight percent, or an amount of from about 0 to about 5 weight percent, based on the total weight of the detergent composition.

Optical brighteners may optionally be included in the detergent composition. Optical brighteners adsorb ultraviolet and/or violet light and re-transmit it as visible light, typically a visible blue light. Optical brighteners include, but are not limited to, derivatives of diaminostilbene disulfonic acid or the alkali metal salts thereof. Suitable compounds are, for example, salts of 4,4'-bis(2-anilino-4-morpholino-1,3,5-triazinyl-6-amino)stilbene 2,2'-disulfonic acid or compounds of similar structure which, instead of the morpholino group, bear a diethanolamino group, a methylamino group, an anilino group or a 2-methoxyethylamino group. Optical brighteners of the substituted diphenylstyryl type may furthermore be present, such as the alkali metal salts of 4,4'-bis(2-sulfostyryl)diphenyl, 4,4'-bis(4-chloro-3-sulfostyryl)diphenyl, or 4-(4-chlorostyryl)-4'-(2-sulfostyryl)diphenyl. Mixtures of the above-stated optical brighteners may also be used. Optical brighteners may be present in the detergent composition at an amount of from about 0 to about 1 weight percent in some embodiments, but in other embodiments optical brighteners are present in an amount of from about 0.01 to about 0.5 weight percent, or an amount of from about 0.05 to about 0.3 weight percent, or an amount of from 0.005 to about 5 weight percent, based on the total weight of the detergent composition.

Foam inhibitors may also optionally be included in the detergent composition. Suitable foam inhibitors include, but are not limited to, soaps of natural or synthetic origin, which include an elevated proportion of C18-C24 fatty acids. Suitable non-surfactant foam inhibitors are, for example, organopolysiloxanes and mixtures thereof with microtine, optionally silanized silica as well as paraffins, waxes, microcrystalline waxes and mixtures thereof with silanized silica or bis-fatty acid alkylenediamides. Mixtures of different foam inhibitors may also be used, for example mixtures of silicones, paraffins or waxes. In an exemplary embodiment, mixtures of paraffins and bistearylethylenediamide may be used. The detergent composition may include the foam inhibitor at an amount of from about 0 to about 5 weight percent, but in other embodiments the foam inhibitor may be present at an amount of from about 0.05 to about 3 weight percent, or an amount of from about 0.5 to about 2 weight percent, based on the total weight of the detergent composition.

Chelators bind and remove calcium, magnesium, or other metals from water, and may optionally be included in the detergent composition. Many compounds can be used as water softeners, including but not limited to ethylenediaminetetraacetic acid (EDTA), nitrilotriacetic acid, diethylenetriaminepenta(methylenephosphonic acid), nitrilotris (methylenephosphonic acid), 1-hydroxyethane-1,1-diphosphonic acid, iminodisuccinic acid (IDS), or other chelating agents. Chelators may be present in the detergent composition at an amount of from about 0 to about 5 weight percent in an exemplary embodiment, but in alternate embodiments the chelators are present at an amount of from about 0.01 to about 3 weight percent or an amount of from about 0.02 to about 1 weight percent, based on the total weight of the detergent composition.

Bittering agents may optionally be added to hinder accidental ingestion of the single dose pack or the detergent composition. Bittering agents are compositions that taste bad, so children or others are discouraged from accidental ingestion. Exemplary bittering agents include denatonium benzoate, aloin, and others. Bittering agents may be present in the detergent composition at an amount of from about 0 to about 1 weight percent, or an amount of from about 0 to about 0.5 weight percent, or an amount of from about 0 to about 0.1 weight percent in various embodiments, based on the total weight of the detergent composition.

The fabrics and/or garments subjected to a washing, cleaning or textile care processes contemplated herein may be conventional washable laundry, such as household laundry. In some embodiments, the major part of the laundry is garments and fabrics, including but not limited to knits, woven fabrics, denims, non-woven fabrics, felts, yarns, and toweling. The fabrics may be cellulose based such as natural cellulosics, including cotton, flax, linen, jute, ramie, sisal or coir or manmade cellulosics (e.g., originating from wood pulp) including viscose/rayon, ramie, cellulose acetate fibers (tricell), lyocell or blends thereof. The fabrics may also be non-cellulose based such as natural polyamides including wool, camel, cashmere, mohair, rabbit, and silk, or the fabric may be a synthetic polymer such as nylon, aramid, polyester, acrylic, polypropylene and spandex/elastin, or blends of any of the above-mentioned products. Examples of blends are blends of cotton and/or rayon/viscose with one or more companion material such as wool, synthetic fibers (e.g., polyamide fibers, acrylic fibers, polyester fibers, polyvinyl alcohol fibers, polyvinyl chloride fibers, polyurethane fibers, polyurea fibers, aramid fibers), and cellulose-containing fibers (e.g., rayon/viscose, ramie, flax, linen, jute, cellulose acetate fibers, lyocell).

In one embodiment, the fabrics and/or garments are added to a washing machine, and the single dose pack including the detergent composition of the present disclosure is also added to the washing machine before wash water is added. In an alternate embodiment, the single dose pack may be added to an automatic detergent addition system of a washing machine, where the contents of the single dose pack are added to the wash water with the fabrics and/or garments after the washing process has begun. In yet another embodiment, the single dose pack is manually added to the fabrics and/or garments with the wash water after the washing process has started. The detergent composition added to the water in the washing machine is referred to as a wash liquor. The fabrics and/or garments are laundered (agitated) with the wash water and the contents of the single dose pack (i.e., the wash liquor). The fabrics and/or garments may then be dried (for example in a drying machine) and otherwise processed as normal.

Illustrative Examples

The present disclosure is now illustrated by the following non-limiting examples. It should be noted that various changes and modifications can be applied to the following examples and processes without departing from the scope of this disclosure, which is defined in the appended claims. Therefore, it should be noted that the following examples should be interpreted as illustrative only and not limiting in any sense.

As shown in Table 1, two detergent compositions for use in a unit dose pack were prepared with the ingredients as described above, wherein the "Inventive" composition includes an organic acid (citric acid, 1.00% by weight) whereas the "Reference" composition does not include citric acid. The values shown in Table 1 represent the weight percent of each component, based on the total weight of the respective detergent compositions.

TABLE 1

| Ingredient (% active by weight) | Reference | Inventive |
|---|---|---|
| Glycerin | 12.76 | 11.84 |
| PEG | 15.59 | 14.47 |
| Ethanol | 3.12 | 3.12 |
| Alcohol ethoxylate (7EO) | 23.07 | 23.07 |
| Monethanolamine | 1.75 | 2.80 |
| LAS | 4.80 | 4.80 |
| Coconut Fatty Acid | 4.00 | 4.00 |
| Alkyl Ether Sulfate (3EO) | 15.60 | 15.60 |
| Citric Acid | 0 | 1.00 |
| IDS | 0.31 | 0.31 |
| Styrene-methacrylate copolymer | 0.53 | 0.53 |
| Bittering Agent | 0.050 | 0.050 |
| Protease | 2.000 | 2.000 |
| Mannanase | 0.600 | 0.600 |
| Amylase | 0.350 | 0.350 |
| Distyryl Biphenyl Disulfonate | 0.300 | 0.300 |
| Fragrance | 1.600 | 1.600 |
| Dye | 0.026 | 0.026 |
| Total Water | 13.80 | 13.80 |

Experimental Procedure: Three sets of two unit dose packs (one each of the Reference and Inventive) were placed into a plastic bag and then stored at 24° C., 40° C., and 45° C. for four weeks. FIG. 1 shows the images of these packs with each respective Reference/Inventive set for the same aging temperature juxtaposed. It is clearly shown in FIG. 1 that the Inventive samples with 1% citric acid have much lower efflorescences on the pack film compared to the Reference samples without citric acid.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A unit dose pack comprising:

a water-soluble film container forming a single chamber; and a detergent composition contained within the single chamber of the water-soluble film container, wherein the detergent composition comprises:

two or more sulfur-containing ionic surfactants comprising linear alkylbenzene sulfonate and alkyl ether sulfate;

at least one non-aqueous solvent comprising a polyethylene glycol having a molecular weight of from about 200 to about 3000; and an organic acid selected from the group consisting of: maleic acid, lactic acid, propionic acid, valeric acid, caproic acid, carbonic acid, adipic acid, gluconic acid, methylglycinediacetic acid, and a mixture thereof.

2. The unit dose pack of claim 1, wherein the linear alkylbenzene sulfonate is present in an amount of about 1% to about 30%, based on total weight of the detergent composition.

3. The unit dose pack of claim 1, wherein the alkyl ether sulfate is present in an amount of from about 5% to about 30%, based on total weight of the detergent composition.

4. The unit dose pack of claim 1, further comprising a nonionic alcohol ethoxylate as an additional surfactant.

5. The unit dose pack of claim 1, further comprising a fatty acid as an additional surfactant.

6. The unit dose pack of claim 1, wherein the polyethylene glycol having a molecular weight of from about 300 to about 2000.

7. The unit dose pack of claim 1, wherein the polyethylene glycol is present in an amount of about 1% to about 40%, based on total weight of the detergent composition.

8. The unit dose pack of claim 1, further comprising water as an additional solvent.

9. The unit dose pack of claim 8, wherein the water is present in an amount of about 5% to about 35%, based on total weight of the detergent composition.

10. The unit dose pack of claim 1, further comprising glycerin as an additional solvent.

11. The unit dose pack of claim 10, wherein the glycerin is present in an amount of about 5% to about 30%, based on total weight of the detergent composition.

12. The unit dose pack of claim 1, wherein the organic acid is present in an amount of about 0.1% to about 5%, based on total weight of the detergent composition.

13. The unit dose pack of claim 1, further comprising at least one beneficial composition selected from the group consisting of: enzymes, peroxy compounds, bleach activators, anti-redeposition agents, neutralizers, optical brighteners, foam inhibitors, chelators, bittering agents, dye transfer inhibitors, soil release agents, water softeners, and mixtures thereof.

* * * * *